US009113661B2

(12) United States Patent
Nasta et al.

(10) Patent No.: US 9,113,661 B2
(45) Date of Patent: Aug. 25, 2015

(54) FINE HOSIERY ARTICLE

(76) Inventors: Jami L. Nasta, Cotopaxi, CO (US); Gary H. Nasta, Cotopaxi, CO (US); Jessica C. Fisher, Canon City, CO (US)

( * ) Notice: Subject to any disclaimer, the term of this patent is extended or adjusted under 35 U.S.C. 154(b) by 907 days.

(21) Appl. No.: 13/281,256

(22) Filed: Oct. 25, 2011

(65) Prior Publication Data

US 2013/0098118 A1 Apr. 25, 2013

(51) Int. Cl.

| | |
|---|---|
| ***A41B 11/14*** | (2006.01) |
| ***D04B 1/26*** | (2006.01) |
| ***A41B 11/00*** | (2006.01) |

(52) U.S. Cl.

CPC ..... *A41B 11/14* (2013.01); *A41B 11/003* (2013.01); *D04B 1/26* (2013.01)

(58) Field of Classification Search

CPC ..... D04B 1/26; D04B 9/46; D04B 9/56; D04B 11/28; D04B 11/34; A41B 11/003; A41B 11/004; A41B 11/14; A41B 11/143; A41B 11/146

USPC ..... 66/178 R, 179, 181; 2/239, 241, 242

See application file for complete search history.

(56) References Cited

U.S. PATENT DOCUMENTS

| | | | | | |
|---|---|---|---|---|---|
| 319,131 | A | * | 6/1885 | Ryer | 2/239 |
| 615,271 | A | * | 12/1898 | Hayden et al. | 2/239 |
| 1,833,163 | A | * | 11/1931 | Ischinger | 2/239 |
| 2,636,287 | A | * | 4/1953 | Heilbronner | 36/9 R |
| 3,995,322 | A | * | 12/1976 | Chesebro, Jr. | 2/239 |
| 4,216,662 | A | | 8/1980 | Harris, Jr. et al. | |
| 4,240,160 | A | | 12/1980 | Imboden et al. | |
| 4,277,959 | A | | 7/1981 | Thorneburg | |
| 4,373,361 | A | | 2/1983 | Thorneburg | |
| 4,506,392 | A | * | 3/1985 | White | 2/239 |
| 4,615,188 | A | | 10/1986 | Hursh et al. | |
| 4,898,007 | A | * | 2/1990 | Dahlgren | 66/185 |
| 5,020,164 | A | * | 6/1991 | Edwards | 2/239 |
| 5,097,537 | A | * | 3/1992 | Ewing | 2/409 |
| 5,103,656 | A | * | 4/1992 | Hanson, II | 66/185 |
| 5,133,088 | A | | 7/1992 | Dunlap | |
| 5,325,541 | A | * | 7/1994 | Willard | 2/239 |
| D354,716 | S | * | 1/1995 | Sheridan | D11/126 |
| 5,473,781 | A | * | 12/1995 | Greenberg | 2/239 |
| 5,509,282 | A | * | 4/1996 | Ferrell, Jr. | 66/188 |
| 5,560,226 | A | | 10/1996 | Throneburg | |
| 5,671,482 | A | | 9/1997 | Alvera | |
| 5,724,836 | A | * | 3/1998 | Green | 66/185 |
| 5,768,713 | A | | 6/1998 | Crick | |
| 5,787,509 | A | | 8/1998 | Alvera | |
| 5,946,731 | A | * | 9/1999 | Finlay et al. | 2/239 |
| 5,953,759 | A | * | 9/1999 | Bozzini | 2/409 |
| 6,082,146 | A | * | 7/2000 | Dahlgren | 66/185 |
| 6,105,173 | A | * | 8/2000 | Brown | 2/239 |
| 6,209,141 | B1 | * | 4/2001 | Adeli | 2/239 |
| 6,606,750 | B2 | * | 8/2003 | Solwey | 2/239 |

(Continued)

*Primary Examiner* — Danny Worrell

(74) *Attorney, Agent, or Firm* — Hayes Soloway P.C.

(57) ABSTRACT

A one piece fine hosiery article in knee length, thigh length and/or panty hose wherein the uniqueness of this invention lies in the foot portion of nylon, or similar materials used in the prior art, being eliminated and replaced with a minimal slip, moisture wicking partial sock. The partial sock completely encompasses the upper and lower portions of the toe, the ball, sole, instep, outstep, and upper and lower portions of the heel of the foot leaving the upper portion of the foot from the toe joints upwards encased in nylon or similar materials used in the prior art, thereby establishing fit, form and comfort to the wearer of fine hosiery articles.

15 Claims, 8 Drawing Sheets

(56) References Cited

U.S. PATENT DOCUMENTS 6,684,412 B2 * 2/2004 Ricci et al. ..... 2/240
6,735,988 B1 5/2004 Honeycutt
D601,336 S * 10/2009 Stewart ..... D2/980
7,748,058 B2 * 7/2010 Steitle ..... 2/244
8,603,019 B1 * 12/2013 Hermanson et al. ..... 602/60

* cited by examiner

1310

FINE HOSIERY ARTICLE

BACKGROUND OF THE INVENTION

1. Field of the Invention

This invention generally relates to footwear, and in particular to fine hosiery in knee length, thigh length and panty hose wherein the upper toes, lower toes, upper heel and the entire sole, instep and outstep, and/or heel areas are a cushioning, absorbent, elastic type material, i.e., a partial sock.

2. Relevant Background

Many women wear hosiery for aesthetic and other reasons. Further, many working women either prefer or are required to wear nylon hosiery while performing their jobs. However, wearing nylon hosiery can be problematic; many wearers of nylon stockings complain of discomfort, disfigurement, foot odor, shoe odor and shoe degradation, slippage, medical, and other issues.

In the related art, many attempts at relieving the wearer of these situations have been attempted by manufacturers and inventors alike; however, none have been able to accommodate the combination of sock and nylon to the various foot sizes, overcome the slippage of the nylon off the heel or bunching under the toes, or minimize the stretch pressure differential causing an uncomfortable tightness in the toes as well as the more common problems mentioned above.

U.S. Pat. No. 5,560,226 to Throneburg discusses a foot protector that provides a cushioning comfort to the ball portion, i.e., bottom or planar areas, to concentrate cushioning where most needed. This foot protector is designed to be worn separately over the wearer's foot and underneath the hosiery.

One problem with that approach is that the foot protector sits high on the wearer's foot, thereby providing no concealment and is aesthetically displeasing. Another problem with that approach is that there is no method for retaining the foot protector in place on the foot, and the foot protector easily slides down towards the heel or bunches under the toes of the wearer.

U.S. Pat. Nos. 5,671,482 and 5,787,509 to Alvera discuss a stocking having a comfort foot area. The comfort foot area encompasses the toe, sole, and heel areas of the foot. A pad is sized to cover and secure to the comfort area or is integrally woven into the comfort area to act as a liner to protect and comfort the foot of the wearer of the stocking.

One problem with that approach is that as the pad is integrally woven into the comfort area of the stocking, the same issues associated with having nylon type material under the foot as discussed still exists. Another problem with that approach is that, as the pad is secured to the nylon material of the stocking, slippage of the upper nylon material can result in tightness in the toe area and may cause bunching under the toe area and slippage from the heel. Since there is significant stretch differential between the two interwoven materials, the dominant material can cause the subordinate material to shift. Yet another problem with that approach is that there is limited accommodation of the varying foot sizes, as the surface area of the foot portion of the interwoven design is integrated with the stocking. Therefore, the pad must remain fixed and not stretchable.

U.S. Pat. No. 5,768,713 to Crick discusses a hosiery article with moisture absorbing pads including a pair of panty hose wherein the foot pads are dimensioned for securing to an interior lower surface of a pair of foot portions of the panty hose. The foot pads are placed under the wearer's feet when wearing the pair of panty hose to absorb perspiration.

One problem with that approach is that it retains the nylon-type material along the bottom portion of the foot and, therefore, does not resolve most of the aforementioned issues common with wearing nylon-type material. Another problem with that approach is that the hosiery article comprises two dissimilar materials with different stretch properties; therefore, placement retention is not possible for having an instep and outstep that provides lateral stability within the garment. Yet another problem with that approach is that the pads have a fixed surface area limiting the capability of the hosiery article from accommodating various foot sizes.

U.S. Pat. No. 6,735,988 to Honeycutt discusses a knitted cotton footie and stocking that includes a top portion, a bottom portion, and a knitted seam. The top portion has a cross stretch less than about 12. The bottom portion may be formed from a lock stitch and may have a cross stretch greater than about 12. The seam comprises a knitted transition zone between the top and bottom portions and extends substantially from the toe of the bottom portion of the heel of the bottom portion, thereby forming the sides and sole of said knitted article.

One problem with that approach is that the entire cotton footie and stocking are knitted in one integrated article; therefore, the article is limited in material selections and, thus, limited to the less desirable properties of such materials. Another problem with that approach is that knitting of the top and bottom portions with two respectively different materials with different stretch properties require a planned manufacturing process that is complicated and not flexible to accommodate a change in material used.

There is further need for a hosiery and a method for producing a hosiery that decreases discomfort, disfigurement, foot odor, shoe odor and shoe degradation, slippage, medical, and other issues with a simple, efficient, and robust producing process.

SUMMARY OF THE INVENTION

Accordingly, the invention is directed to a fine hosiery article and method of producing a fine hosiery article.

An objective of an embodiment of the invention is to provide a fine hosiery article that alleviates or reduces the discomfort, disfigurement, foot odor, shoe odor and shoe degradation, slippage, medical, and other issues associated with stockings.

Another objective of an embodiment of the invention is to provide a method of producing a fine hosiery article from a readily commercially available stocking and sock that is simple, efficient, and robust.

Yet another objective of an embodiment of the invention is to provide a method of producing a fine hosiery article from partial stockings and ankle socks, each made from a variety of materials. The partial stocking can be made of nylon, while the partial ankle sock can be made of cotton or other suitable materials. In this aspect, an objective of an embodiment of the invention is to result in a more comfortable and durable hosiery, combining the aesthetic quality of nylon stocking with the minimal slip, moisture wicking, warmth and comfort of the partial sock.

According to an aspect of an embodiment of the invention, a fine hosiery article comprises an upper portion comprising a partial stocking, a lower portion comprising a partial sock, and a couple joining a lower edge of the partial stocking and the upper edge of the partial sock, wherein the coupling is uncoordinated with stitchings of the partial stocking or the partial sock. According to another aspect of an embodiment of the invention, the lower edge of the partial stocking comprises a substantially tubular contour that is tangentially angled to a first edge at a length of a lower portion of the partial stocking and tangentially perpendicular to an opposite edge to the first edge at the length of the lower portion of the partial stocking. According to yet another aspect of an embodiment of the invention, the partial sock comprises a double knit area at a bottom and a front and front-top portions of the partial sock, a curved up heel area at a back portion of the partial sock, and a small single knit area behind the front-top portion of the partial sock.

According to an aspect of an embodiment of the invention, a method of producing a fine hosiery articles comprises removing a foot area of a stocking resulting in a partial stocking with an open lower edge, removing a top portion of a sock resulting in a partial sock with an open upper edge, and joining the open lower edge of the partial stocking to the open upper edge of the partial sock.

According to an aspect of an embodiment of the invention, a method of producing a fine hosiery article comprises joining a lower edge of a partial stocking to an upper edge of a partial sock, wherein the joining is uncoordinated with stitchings of the partial stocking and the partial sock.

BRIEF DESCRIPTION

Figure 13A:
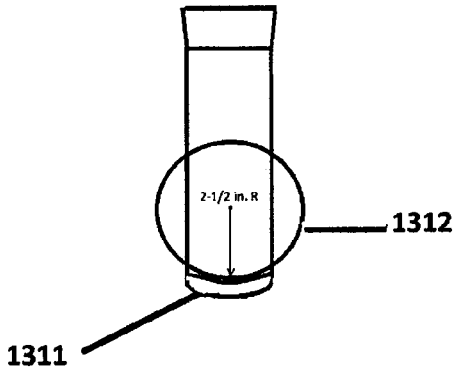
Figure 13B:
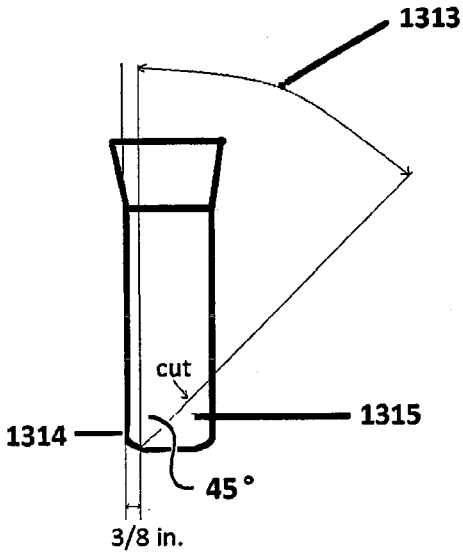
Figure 13C:
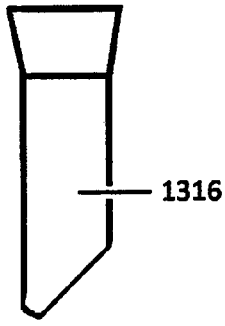

FIGS. 13A, 13B, and 13C illustrate a method of modification of a stocking hosiery according to an embodiment of the invention.

Figure 14A:
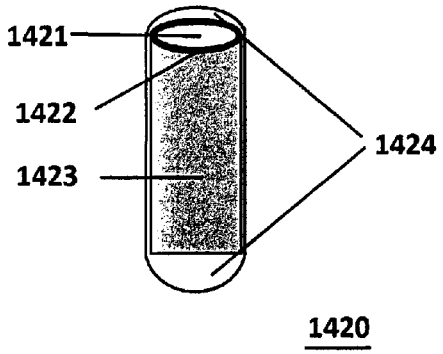
Fig.14A prior art
Figure 14B:
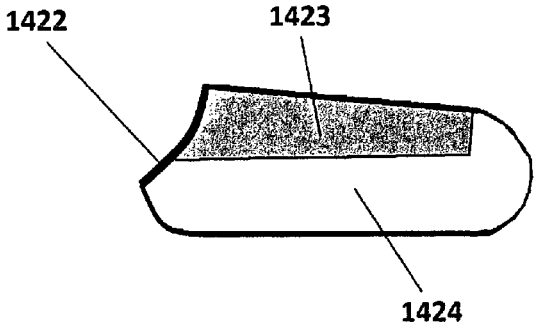
Fig. 14B prior art

FIGS. 14A and 14B illustrate a top view and side view, respectively, of an ankle sock in the prior art.

Figure 15A:
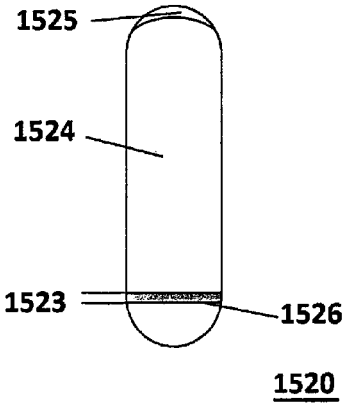
Figure 15B:
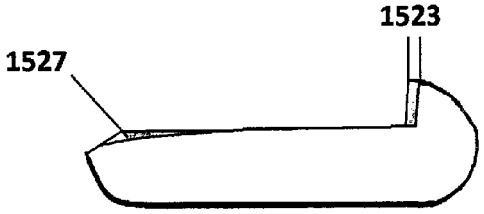

FIGS. 15A and 15B illustrate a top view and side view, respectively, of a modified ankle sock according to an embodiment of the invention.

Figure 16A:
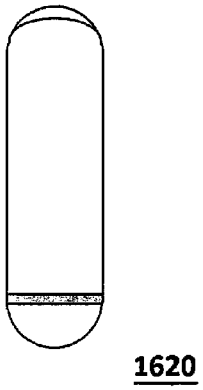
Figure 16B:
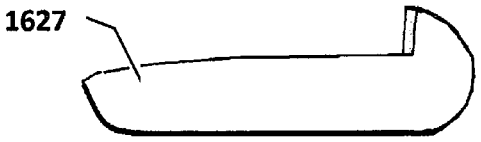

FIGS. 16A and 16B illustrate a top view and side view, respectively, of a completed modified ankle sock portion according to an embodiment of the invention.

DETAILED DESCRIPTION OF THE PREFERRED EMBODIMENTS

Embodiments of the present invention are hereafter described in detail with reference to the accompanying figures and are provided for purposes of illustration only and not for the purpose of limiting the invention as defined by the appended claims and their equivalents. Descriptions of well-known functions and constructions are omitted for clarity and conciseness. The figures are meant to illustrate features of exemplary embodiments of the invention and are not drawn to scale.

A detailed description of the present invention follows, utilizing the accompanying drawings as referenced by the Figures. The preferred embodiments are referenced as each figure is addressed.

Figure 1A:
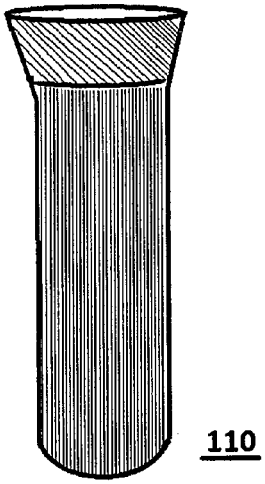
Fig. 1A prior art
FIGS. 1A and 1B illustrate a tubular knee length stocking and a standard ankle sock, respectively, in the prior art.

FIG. 1A illustrates knee length stocking 110 in the prior art. Stocking 110 in its current form is incompatible with attachment of the partial sock and must be modified in order to prevent an excessive stretch of the nylon along the upper surface of the foot. This excessive stretch will cause an uncomfortable tightness in the toe portion of the sock and will result in the partial sock slipping off of the heel of the foot and bunching under the toes of the wearer.

Figure 1B:
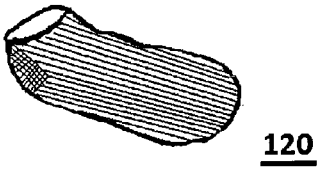
Fig. 1B prior art

FIG. 1B illustrates a standard ankle sock 120 in the prior art. Although comfortable and adequate for wear, standard ankle sock 120 presents an unsightly appearance when worn with nylons. Some modification is required to complement a fashionable stocking according to an embodiment of the present invention. The result of this modification is a hosiery that is form fitting and comfortable, but has little to no visual presence when worn with shoes. Preferably, it should be made of a material suitable for long term wear next to the skin, able to absorb perspiration and adequate to prevent chaffing of the skin.

Figure 2A:
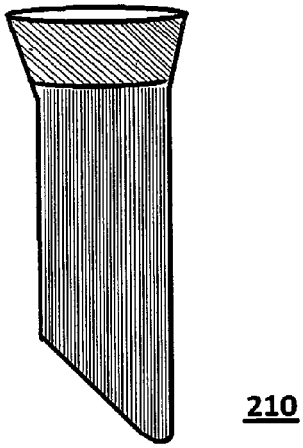
FIGS. 2A and 2B illustrate a modified partial knee length stocking and ankle sock, respectively, according to an embodiment of the invention.

FIG. 2A illustrates a modified knee length stocking 210 according to an embodiment of the invention. Preferably, such modification results in the length of the nylon in the front being significantly longer than the length of the nylon in the rear, and tapers from front to rear along the sides. This modification is preferred to achieve differential stretch properties needed to retain a partial sock in its proper position on the foot. This angle tapering towards the rear also retains the partial sock in the proper position along the instep and outstep of the foot. A greater angle towards the vertical results in an excess of tension in the heel area and will cause the toe of the partial sock to be pulled beneath the toes. A greater angle towards the horizontal will result in a lack of tension in the heel and results in the partial sock slipping off of the heel. Greater detail of preferred embodiments of this modification will be discussed in the section describing FIG. 13.

Figure 2B:
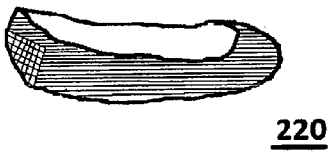

FIG. 2B illustrates a modified ankle sock 220 according to an embodiment of the invention. Such modification results in a flat piece of material that has a slight curvature upwards at the heel and a significantly greater curvature upwards at the toe area. This modification is the basis for a form fitting partial sock that will complete the lower portion of the stocking. It must be of significantly less material than the original sock so as not to have a visual signature when placed on the foot of the wearer and placed inside the shoe. A further discussion of preferred embodiments of this modification will be discussed in the section describing FIG. 14.

Figure 3:
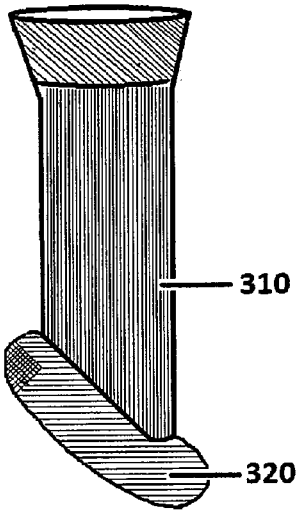
FIG. 3 illustrates a modified knee length stocking and ankle sock combined according to an embodiment of the invention.

FIG. 3 illustrates combining modified knee length stocking 310 and modified partial sock 320 according to an embodiment of the invention. During this phase of construction, it is preferable for the comfort of the wearer, that the seam be flat and smooth. The heel portion of partial sock 320 should protrude slightly from the vertical line of the stocking to accommodate the heel of the wearer and so as not to exude additional stretch pressure already accomplished by the angular cut of the nylon. The slightly rounded portion of the toe areas of both the nylon and the partial sock, discussed with FIGS. 13 and 14, should be aligned to produce a smooth and uniform seam across the top portion of the toe area.

Figure 4A:
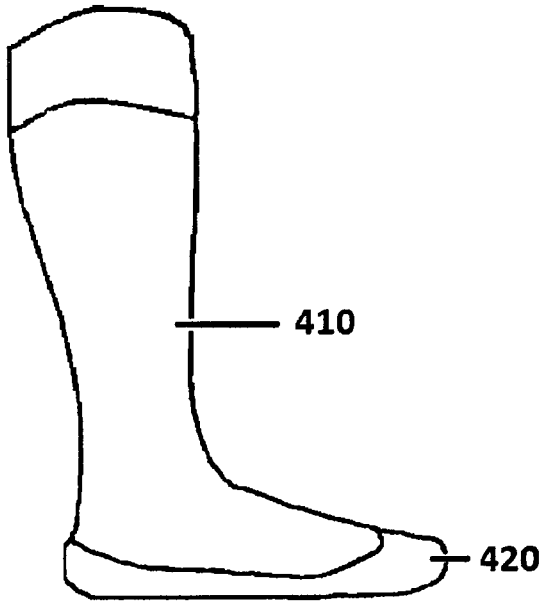
FIGS. 4A and 4B illustrate a modified knee length stocking and ankle sock combined on a wearer's bare foot and while wearing a shoe, respectively, according to an embodiment of the invention.

FIG. 4A illustrates the appearance of the completed construction of a combined modified knee length stocking 410 and modified partial sock 420 when placed on the foot of the wearer according to an embodiment of the invention. Preferably, partial sock 420 should present a low profile appearance along the instep and outstep while maintaining a low position over the heel and should minimally cover the upper toe area terminating at the second joint of the toes.

Figure 4B:
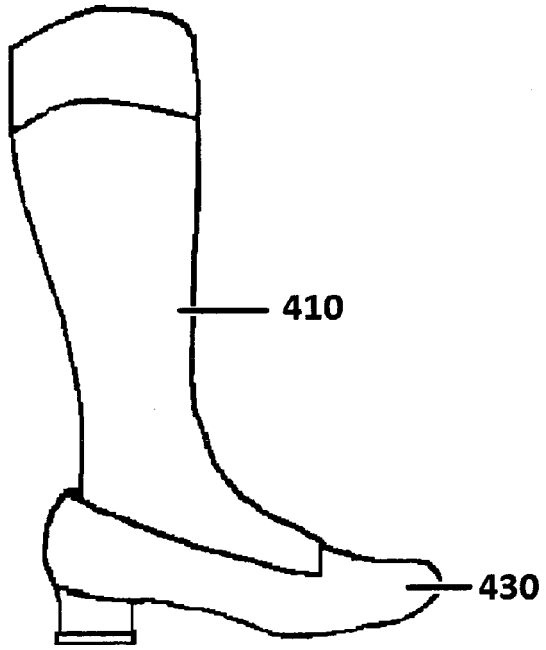

FIG. 4B demonstrates the preferred appearance of a combined modified knee length stocking 410 and sock when placed within shoe 430 of the wearer according to an embodiment of the invention. The combined partial sock and nylon should have the same appearance when in the shoe as any standard, non-modified nylon would have. Preferably, the partial sock should have a zero visual profile and the seam of the combined stocking and partial sock should have no adverse effects to the comfort of the wearer.

Figure 5A:
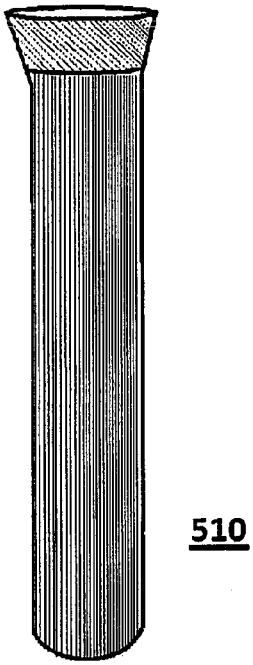
Fig. 5A prior art
FIGS. 5A and 5B illustrate a tubular thigh length stocking and a standard ankle sock, respectively, in the prior art.

FIG. 5A illustrates thigh length stocking 510 in the prior art. Stocking 510 in its current form is incompatible with attachment of the partial sock and must be modified in order to prevent an excessive stretch of the nylon along the upper surface of the foot. This excessive stretch will cause an uncomfortable tightness in the toe portion of the sock and result in the partial sock slipping off of the heel of the foot and bunching under the toes of the wearer.

Figure 5B:
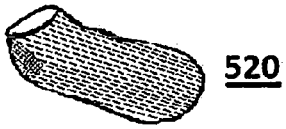
Fig. 5B prior art

FIG. 5B illustrates a standard ankle sock 520 in the prior art. Although comfortable and adequate for wear, standard ankle sock 520 presents an unsightly appearance when worn with nylons. Some modification is required to compliment a fashionable stocking according to an embodiment of the present invention. The result of this modification is form fitting and comfortable but has no visual presence when worn with the shoe. It should be of a material suitable for long term wear next to the skin, able to absorb perspiration and adequate to prevent chaffing of the skin.

Figure 6A:
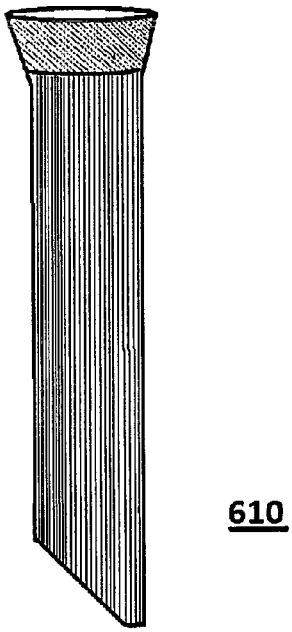
FIGS. 6A and 6B illustrate a modified partial thigh length stocking and ankle sock, respectively, according to an embodiment of the invention.

FIG. 6A illustrates modified thigh length stocking 610 according to an embodiment of the invention. Preferably, such modification results in the length of the nylon in the front being significantly longer than the length of, the nylon in the rear, and tapers from front to rear along the sides. This modification is preferred to achieve differential stretch properties needed to retain a partial sock in its proper position on the foot. This angle tapering towards the rear also retains the partial sock in the proper position along the instep and outstep of the foot. A greater angle towards the vertical results in an excess of tension in the heel area and will cause the toe of the partial sock to be pulled beneath the toes. A greater angle towards the horizontal will result in a lack of tension in the heel and will result in the partial sock slipping off of the heel. Greater detail of preferred embodiments of this modification will be discussed in the section describing FIG. 13.

Figure 6B:
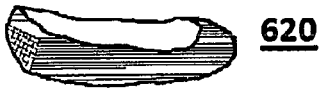

FIG. 6B illustrates a modified ankle sock 620 according to an embodiment of the invention. Such modification results in a flat piece of material that has a slight curvature upwards at the heel and a significantly greater curvature upwards at the toe area. This modification is the basis for a form fitting partial sock that will complete the lower portion of the stocking. It must be of significantly less material than the original sock so as not to have a visual signature when placed on the foot of the wearer and placed inside the shoe. A further discussion of preferred embodiments of this modification will be discussed in the section describing FIG. 14.

Figure 7:
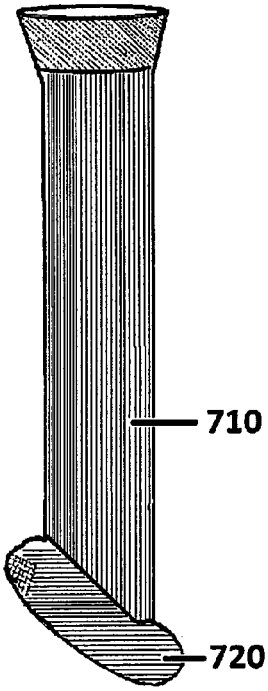
FIG. 7 illustrates a modified thigh length stocking and ankle sock combined according to an embodiment of the invention.

FIG. 7 illustrates combining modified thigh length stocking 710 and modified partial sock 720 according to an embodiment of the invention. During this phase of construction, it is preferable for the comfort of the wearer, that the seam be flat and smooth. The heel portion of partial sock 720 should protrude slightly from the vertical line of the stocking to accommodate the heel of the wearer and so as not to exude additional stretch pressure already accomplished by the angular cut of the nylon. The slightly rounded portion of the toe areas of both the nylon and the partial sock, discussed with FIGS. 13 and 14, should be aligned to produce a smooth and uniform seam across the top portion of the toe area.

Figure 8A:
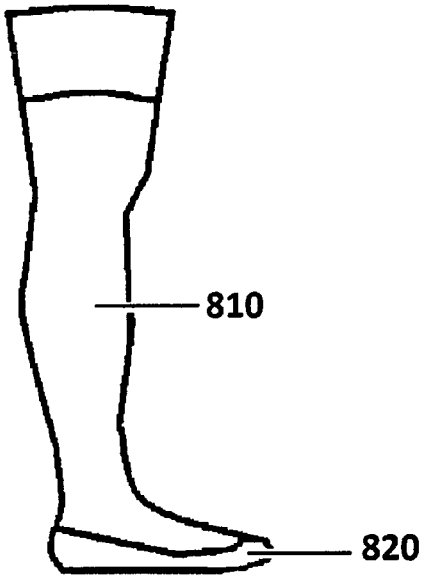
FIGS. 8A and 8B illustrate a modified thigh length stocking and ankle sock combined on a wearer's bare foot and while wearing a shoe, respectively, according to an embodiment of the invention.

FIG. 8A illustrates the appearance of the completed construction of a combined modified thigh length stocking 810 and modified partial sock 820 when placed on the foot of the wearer according to an embodiment of the invention. Preferably, partial sock 420 should present a low profile appearance along the instep and outstep while maintaining a low position over the heel and should minimally cover the upper toe area terminating at the second joint of the toes.

Figure 8B:
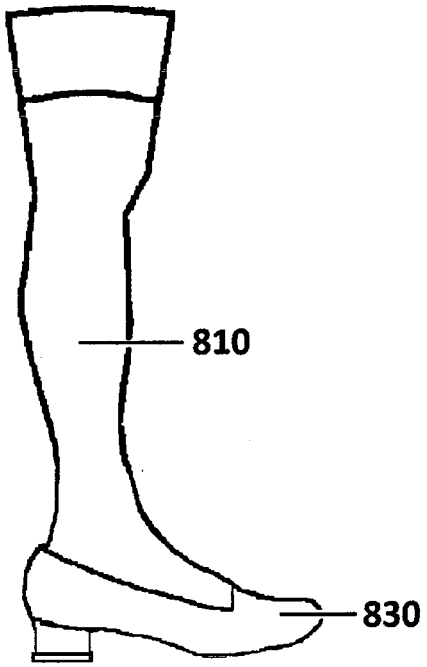

FIG. 8B demonstrates the preferred appearance of a combined modified thigh length stocking 810 and sock when placed within shoe 830 of the wearer according to an embodiment of the invention. The combined partial sock and nylon should have the same appearance when in the shoe as any standard, non-modified nylon would have. Preferably, the partial sock should have a zero visual profile and the seam of the combined stocking and partial sock should have no adverse effects to the comfort of the wearer.

Figure 9A:
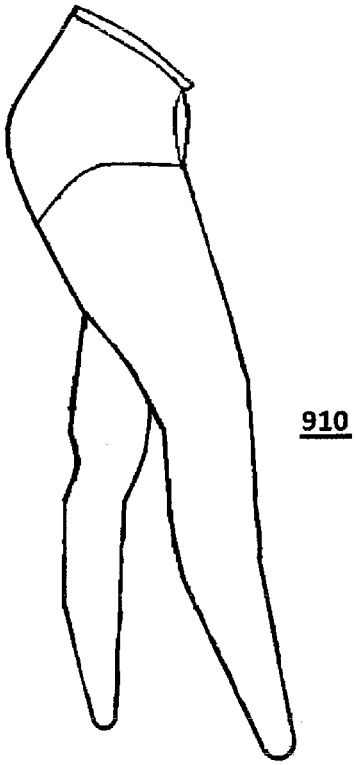
Fig. 9A prior art
FIGS. 9A and 9B illustrate a panty hose and a standard ankle sock, respectively, in the prior art.

FIG. 9A illustrates panty hose 910 in the prior art. Panty hose 910 in its current form is incompatible with attachment of the partial sock and must be modified in order to prevent an excessive stretch of the nylon along the upper surface of the foot. This excessive stretch will cause an uncomfortable tightness in the toe portion of the sock and will result in the partial sock slipping off of the heel of the foot and bunching under the toes of the wearer.

Figure 9B:
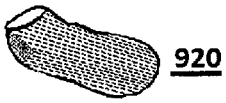
Fig. 9B prior art

FIG. 9B illustrates a standard ankle sock 920 in the prior art. Although comfortable and adequate for wear, standard ankle sock 920 presents an unsightly appearance when worn with nylons. Some modification is required to complement a fashionable stocking according to an embodiment of the present invention. The result of this modification is a hosiery that is form fitting and comfortable, but has little to no visual presence when worn with shoes. Preferably, it should be made of a material suitable for long term wear next to the skin, able to absorb perspiration and adequate to prevent chaffing of the skin.

Figure 10A:
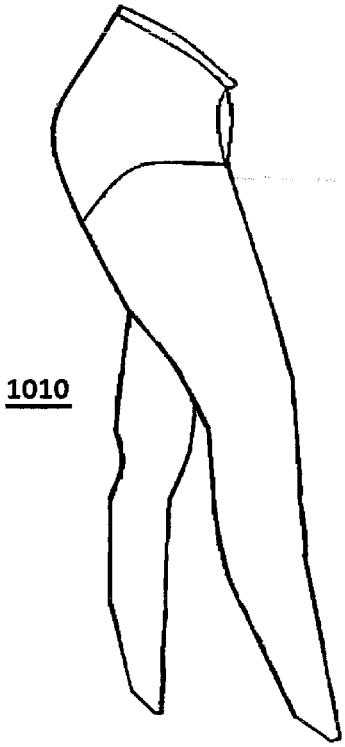
FIGS. 10A and 10B illustrate a modified panty hose and ankle sock, respectively, according to an embodiment of the invention.

FIG. 10A illustrates a modified panty hose 1010 according to an embodiment of the invention. Preferably, such modification results in the length of the nylon in the front being significantly longer than the length of the nylon in the rear, and tapers from front to rear along the sides. This modification is preferred to achieve differential stretch properties needed to retain a partial sock in its proper position on the foot. This angle tapering towards the rear also retains the partial sock in the proper position along the instep and outstep of the foot. A greater angle towards the vertical results in an excess of tension in the heel area and will cause the toe of the partial sock to be pulled beneath the toes. A greater angle towards the horizontal will result in a lack of tension in the heel and will result in the partial sock slipping off of the heel. Greater detail of preferred embodiments of this modification will be discussed in the section describing FIG. 13.

Figure 10B:
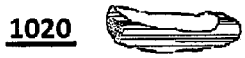

FIG. 10B illustrates a modified ankle sock 1020 according to an embodiment of the invention. Such modification results in a flat piece of material that has a slight curvature upwards at the heel and a significantly greater curvature upwards at the toe area. This modification is the basis for a form fitting partial sock that will complete the lower portion of the stocking. It must be of significantly less material than the original sock so as not to have a visual signature when placed on the foot of the wearer and placed inside the shoe. A further discussion of preferred embodiments of this modification will be discussed in the section describing FIG. 14.

Figure 11:
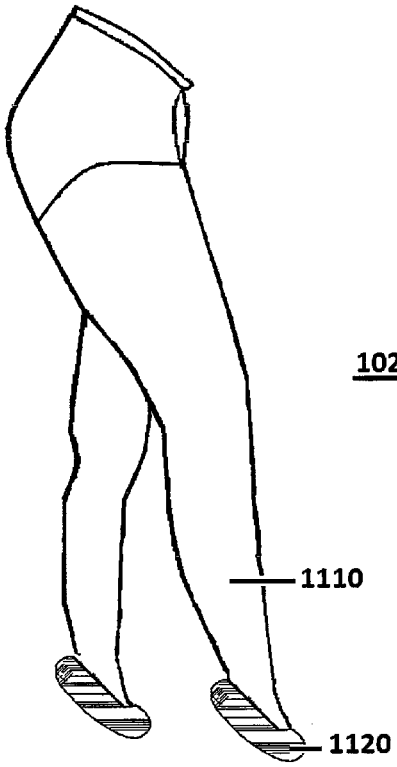
FIG. 11 illustrates a modified panty hose and ankle sock combined according to an embodiment of the invention.

FIG. 11 illustrates combining modified panty hose 1110 and modified partial sock 1120 according to an embodiment of the invention. During this phase of construction, it is preferable for the comfort of the wearer, that the seam be flat and smooth. The heel portion of partial sock 1120 should protrude slightly from the vertical line of the stocking to accommodate the heel of the wearer and so as not to exude additional stretch pressure already accomplished by the angular cut of the nylon. The slightly rounded portion of the toe areas of both the nylon and the partial sock, discussed with FIGS. 13 and 14, should be aligned to produce a smooth and uniform seam across the top portion of the toe area.

Figure 12A:
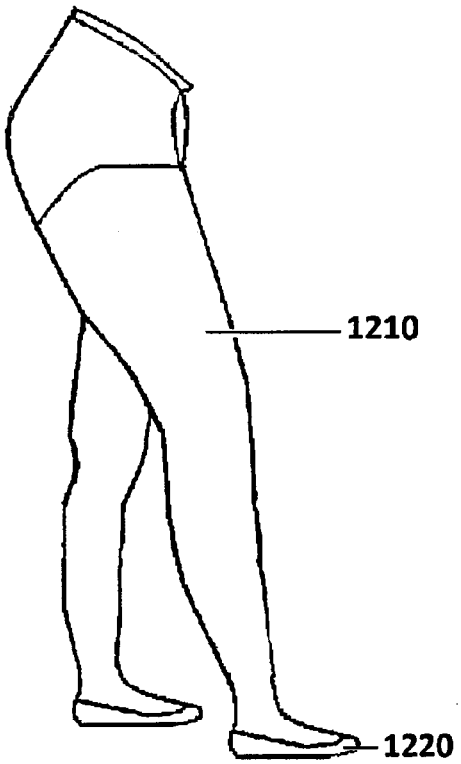
FIGS. 12A and 12B illustrate a modified panty hose and ankle sock combined on a wearer's bare foot and while wearing a shoe, respectively, according to an embodiment of the invention.

FIG. 12A illustrates the appearance of the completed construction of a combined modified panty hose 1210 and modified partial sock 1220 when placed on the foot of the wearer according to an embodiment of the invention. Preferably, partial sock 1220 should present a low profile appearance along the instep and outstep while maintaining a low position over the heel and should minimally cover the upper toe area terminating at the second joint of the toes.

Figure 12B:
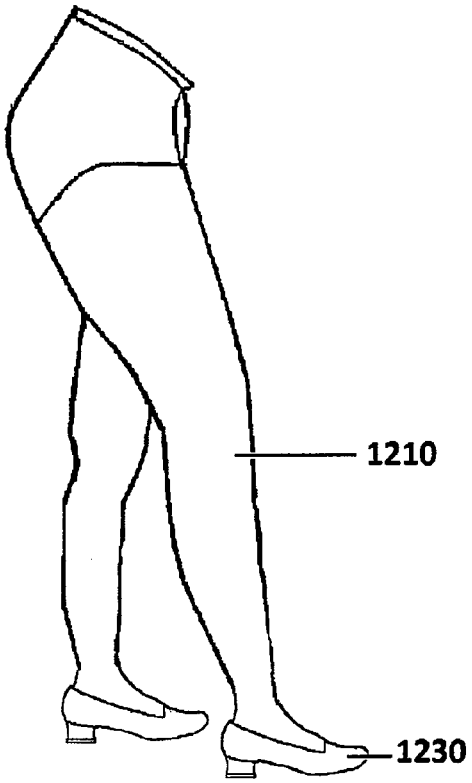

FIG. 12B demonstrates the preferred appearance of a combined modified panty hose 1210 and sock when placed within shoe 1230 of the wearer according to an embodiment of the invention. The combined partial sock and nylon should have the same appearance when in the shoe as any standard, non-modified nylon would have. Preferably, the partial sock should have a zero visual profile and the seam of the combined stocking and partial sock should have no adverse effects to the comfort of the wearer.

FIGS. 13A, 13B, and 13C illustrate a method of modification of stocking hosiery 1310 according to an embodiment of the invention. Stocking hosiery 1310 can be a standard knee or thigh length hosiery, a panty hose, or other suitable standard hosiery as known in the art.

Removal of reinforced toe area 1311 begins the modification process as shown in FIG. 13A. Utilizing a substantially circular radius 1312, stocking hosiery 1310 is cut at the lower portion slightly above reinforced toe area 1311 to provide a "U" shape that conforms to the upper toe region. Preferably, substantially circular radius 1312 is 2½".

Shown in FIG. 13B, once reinforced toe area 1311 is removed, angular cut 1313 is performed beginning at point 1314 from one side of the length of the hosiery article, resulting in an area to be removed 1315. This cut provides an increased length in the front of the article and a decreased length in the rear and establishes a differential stretch pressure for maintaining the partial sock on the foot of the wearer. Preferably, angular cut 1313 at around 45 degrees and point 1314 is around ⅜" from the side of the length of the hosiery article.

FIG. 13C illustrates completed modification of stocking hosiery 1315 according to an embodiment of the invention.

FIGS. 14A and 14B illustrates a top view and side view, respectively, of a standard ankle sock 1420 in the prior art. Ankle sock 1420 comprises a double knit area 1424 at the bottom, front, front-top (toe area), and back (heel area) portions, a single knit area 1423 at the top portion, an opening 1421 on top of the back portion (heel area) to the inside of ankle sock 1420 in order to fit a foot, and an elastic ankle band 1422 around the contour of opening 1421.

FIGS. 15A and 15B illustrate a top view and side view, respectively, of modified ankle sock 1520 according to an embodiment of the invention. Modification process begins by removing most of the single knit material from a standard ankle sock leaving only a small amount of single knit material 1523 behind the toe seam. In a preferred embodiment, the small amount of single knit material 1523 is about ¼". The elastic ankle band of the ankle sock is then removed completely resulting in a slightly curved up heel area 1525. Double knit area 1524 is not removed.

FIGS. 16A and 16B illustrate a top view and side view, respectively, of a completed ankle sock portion according to an embodiment of the invention. After the single knit material and elastic ankle band has been removed, a small area 1627 along the heel on the instep and outstep is trimmed away to facilitate a smooth joining to a modified hosiery as disclosed in the present invention.

A method of producing a fine hosiery article according to an embodiment of the invention is further disclosed. The method comprises joining a lower edge of a partial stocking to an upper edge of a partial sock. In a preferred embodiment, the partial stocking and the partial sock are made of separate and different materials. Therefore, the joining of these different material requires seaming, gluing, or other forms of joining as known in the art that is uncoordinated with the stitchings of either or both of the partial stocking and the partial sock. In another embodiment, the lower edge of the partial stocking comprises a substantially tubular contour that is tangentially angled to a first edge at a length of a lower portion of the partial stocking and tangentially perpendicular to an opposite edge to the first edge at the length of the lower portion of the partial stocking. In yet another embodiment, the partial sock comprises a double knit area at a bottom and a front and front-top portions of the partial sock, a curved up heel area at a back portion of the partial sock, and a small single knit area behind the front-top portion of the partial sock.

Although the invention has been described and illustrated with a certain degree of particularity, it is understood that the present disclosure has been made only by way of example, and that numerous changes in the combination and arrangement of parts can be resorted to by those skilled in the art without departing from the spirit and scope of the invention, as hereinafter claimed.

We claim:

1. A fine hosiery article, comprising:

an upper portion comprising a partial stocking formed of a first material having a first stretch property, the partial stocking being longer in a front portion than in a rear portion, and being tapered at an angle from the front portion to the rear portion along a lower edge of the partial stocking;

a lower portion comprising a partial sock formed of a second material having a second stretch property different from the first stretch property, wherein the partial sock comprises portions adapted to cover an upper and lower toe, ball, instep, outstep, and heel portions of a wearer's foot, and a portion adapted to cover an upper heel portion of a wearer's foot; and a coupling joining the lower edge of the partial stocking and an upper edge of the partial sock, wherein the combined partial sock and partial stocking have the same appearance when in a shoe as an un-modified partial stocking.

2. The fine hosiery article of claim 1, wherein a bottom of the partial sock comprises cushioning.

3. The fine hosiery article of claim 1, wherein the partial sock comprises moisture wicking material.

4. The fine hosiery article of claim 1, wherein the partial stocking comprises a lower leg portion.

5. The fine hosiery article of claim 1, wherein the partial stocking comprises nylon material.

6. The fine hosiery article of claim 1, wherein the partial stocking is adapted to be about knee-length when worn.

7. The fine hosiery article of claim 1, wherein the partial stocking is adapted to be about thigh-length when worn.

8. The fine hosiery article of claim 1, wherein the partial stocking comprises a panty hose portion.

9. The fine hosiery article of claim 1, wherein the coupling comprises a sewing seam.

10. The fine hosiery article of claim 1, wherein the partial sock comprises cotton material.

11. The fine hosiery article of claim 1, wherein the partial sock comprises a double knit area at a bottom and a front and front-top portions of the partial sock, a curved up heel area at a back portion of the partial sock, and a small single knit area behind the front-top portion of the partial sock.

12. A method of producing a fine hosiery article, comprising:

removing a portion of a stocking formed of a first material having a first stretch property, and adapted to cover a wearer's foot at an angle tapering from a front portion of the stocking to a rear portion, resulting in a partial stocking with an open lower edge that is longer in the front portion than in the rear portion;

removing a top portion of a sock formed of a second material having a second stretch property different from the first stretch property, leaving only a curved up heel area at a back portion of the sock adapted to cover a wearer's heel, a bottom sole area adapted to cover a wearer's sole, and a toe area adapted to cover a wearer's toes at front and front-top portions of the sock, resulting in a partial sock with an open upper edge; and joining the open lower edge of the partial stocking to the open upper edge of the partial sock, wherein the combined partial sock and partial stocking have the same appearance when in a shoe as an un-modified partial stocking.

13. The method of claim 12, wherein removing the portion of the stocking adapted to cover a wearer's foot comprises:

removing a reinforced portion adapted to cover a wearer's toes; and cutting a lower edge of the stocking with the removed reinforced toe area at about a 45 degree angle from the front portion to the rear portion.

14. The method of claim 12, wherein joining the open lower edge of the partial stocking to the open upper edge of the partial sock comprising stitching a seam connecting the open lower edge of the partial stocking with the open upper edge of the partial sock around the edges.

15. The method of claim 12, wherein the partial sock comprises a double knit area at a bottom and a front and front-top portions of the partial sock, a curved up heel area adapted to cover a wearer's heel at a back portion of the partial sock, and a small single knit area behind the front-top portion of the partial sock.

* * * * *